US008292080B2

(12) United States Patent
Urquhart et al.

(10) Patent No.: US 8,292,080 B2
(45) Date of Patent: Oct. 23, 2012

(54) SHIPPING CARTON WITH INTEGRAL CUSHION SUPPORT

(75) Inventors: David Urquhart, Bakersfield, CA (US); John Blanck, Mission Viejo, CA (US)

(73) Assignee: Mitsubishi Electric Visual Solutions America, Inc., Irvine, CA (US)

( * ) Notice: Subject to any disclaimer, the term of this patent is extended or adjusted under 35 U.S.C. 154(b) by 0 days.

(21) Appl. No.: 13/032,811

(22) Filed: Feb. 23, 2011

(65) Prior Publication Data

US 2011/0210040 A1 Sep. 1, 2011

Related U.S. Application Data

(60) Provisional application No. 61/308,849, filed on Feb. 26, 2010.

(51) Int. Cl.
*B65D 81/02* (2006.01)

(52) U.S. Cl. ..... 206/586; 206/592

(58) Field of Classification Search ..... 206/453, 206/521, 586, 591, 592, 593; 229/170, 177–179, 229/190, 191, 186, 918
See application file for complete search history.

(56) References Cited

U.S. PATENT DOCUMENTS

| | | | | | |
|---|---|---|---|---|---|
| 2,847,152 | A * | 8/1958 | Van Antwerpen | ..... | 206/591 |
| 3,162,351 | A * | 12/1964 | Rudofski | ..... | 206/586 |
| 3,884,356 | A | 5/1975 | Lidgard | | |
| 4,511,079 | A * | 4/1985 | Lopez | ..... | 229/178 |
| 5,294,044 | A * | 3/1994 | Clark | ..... | 229/191 |
| 5,372,259 | A * | 12/1994 | Suzuki et al. | ..... | 206/586 |
| 5,429,232 | A | 7/1995 | Orr et al. | | |
| 5,996,885 | A | 12/1999 | Chu | | |
| 6,474,541 | B1 | 11/2002 | Chu | | |
| 6,640,971 | B2 | 11/2003 | Acevedo | | |
| 6,651,875 | B2 | 11/2003 | Chu | | |
| 6,904,734 | B2 | 6/2005 | Hardy | | |
| 7,121,453 | B2 | 10/2006 | Nass | | |
| 7,565,998 | B2 * | 7/2009 | McClure | ..... | 206/591 |
| 2005/0211600 | A1 * | 9/2005 | Saito | ..... | 206/586 |
| 2007/0054525 | A1 | 3/2007 | Jones et al. | | |
| 2008/0251572 | A1 * | 10/2008 | Cadio | ..... | 229/101 |

* cited by examiner

*Primary Examiner* — Luan K Bui
(74) *Attorney, Agent, or Firm* — Dickstein Shapiro LLP; Kenneth S. Roberts

(57) ABSTRACT

A shipping carton with an integral cushion support. The carton includes a bottom, two side walls and two end walls extending vertically from the base, and a top. The top and bottom of the carton include two side flaps and two end flaps that are used to close the top and bottom in a conventional manner. The end flaps preferably include a integrally formed cushion support that includes an elongate body having a triangular cross-sectional shape defined by a vertical wall extending away from the end flap and an inclined wall extending from the end of the vertical wall towards the end flap. One or more locking tabs extend from the end of the inclined wall of the cushion support and engage one or more slots formed in the end flap. Alternatively, a locking member extends away from the end flap in the same direction as the vertical wall of the cushion support and includes a locking slot formed adjacent the end flap that is engaged by the one or more locking tabs to lock the cushion support in place. When the end flaps are turned in for closing the top of the carton, the vertical wall of the cushion support abuts or otherwise engages a support member block that is operably engaging at least a portion of the top of the packaged product.

12 Claims, 4 Drawing Sheets

SHIPPING CARTON WITH INTEGRAL CUSHION SUPPORT

CROSS-REFERENCE TO RELATED APPLICATION

This application claims priority to U.S. Provisional Application Ser. No. 61/308,849 filed Feb. 26, 2010, which application is fully incorporated herein by reference.

FIELD

The embodiments described herein relate generally to shipping cartons and, more particularly, to systems and methods that reduce carton material costs and increase packaged product protection.

BACKGROUND INFORMATION

Electronic devices such as large screen televisions a typically packaged in a large carton for shipping. In order to protect the televisions from impact forces transmitted to the television through the carton, the large amounts of cushion and support material, e.g., polystyrene foam blocks, surround the television when packaged in the carton. The cushion and support material adds to the total cost of the television to the consumer. Thus, it would be desirable to provide a carton design that reduces the amount of cushion material needed and, thus, cost of packaging for shipment of the television, while maintaining or increasing the protection of the television against impact forces received by the shipping carton.

SUMMARY

The embodiments provided herein are directed to a shipping carton with an integral cushion support. Like conventional cartons, a preferred embodiment of the carton includes a bottom, two side walls and two end walls extending vertically from the base, and a top. The top and bottom of the carton include two side flaps and two end flaps that are used to close the top and bottom in a conventional manner. The end flaps preferably include a integrally formed cushion support that includes an elongate body having a triangular cross-sectional shape defined by a vertical wall extending away from the end flap and an inclined wall extending from the end of the vertical wall towards the end flap. One or more locking tabs extend from the end of the inclined wall of the cushion support and engage one or more slots formed in the end flap. Alternatively, a locking member extends away from the end flap in the same direction as the vertical wall of the cushion support and includes a locking slot formed adjacent the end flap that is engaged by the one or more locking tabs to lock the cushion support in place.

In operation, the bottom of the carton is closed and an electronic device such as a television in positioned within the carton. When the end flaps are turned in for closing the top of the carton, the vertical wall of the cushion support abuts or otherwise engages a support member block that is operably engaging at least a portion of the top of the television. The cushion support hold the support member block in place against the side wall of the carton, which in turn holds the television in spaced relation with the side and end walls of the carton. The cushion support advantageously reduces the amount of cushion material needed for packaging the television and advantageously reduces the impact forces transmitted to the television, thereby providing better protection to the television than any previous design.

Other systems, methods, features and advantages of the example embodiments will be or will become apparent to one with skill in the art upon examination of the following figures and detailed description.

BRIEF DESCRIPTION OF THE FIGURES

The details of the example embodiments, including structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

It should be noted that elements of similar structures or functions are generally represented by like reference numerals for illustrative purpose throughout the figures. It should also be noted that the figures are only intended to facilitate the description of the preferred embodiments.

DETAILED DESCRIPTION

Each of the additional features and teachings disclosed below can be utilized separately or in conjunction with other features and teachings to produce systems and methods that reduce carton material costs and increase packaged product protection utilizing a carton with an integral cushion support. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Figure 1:
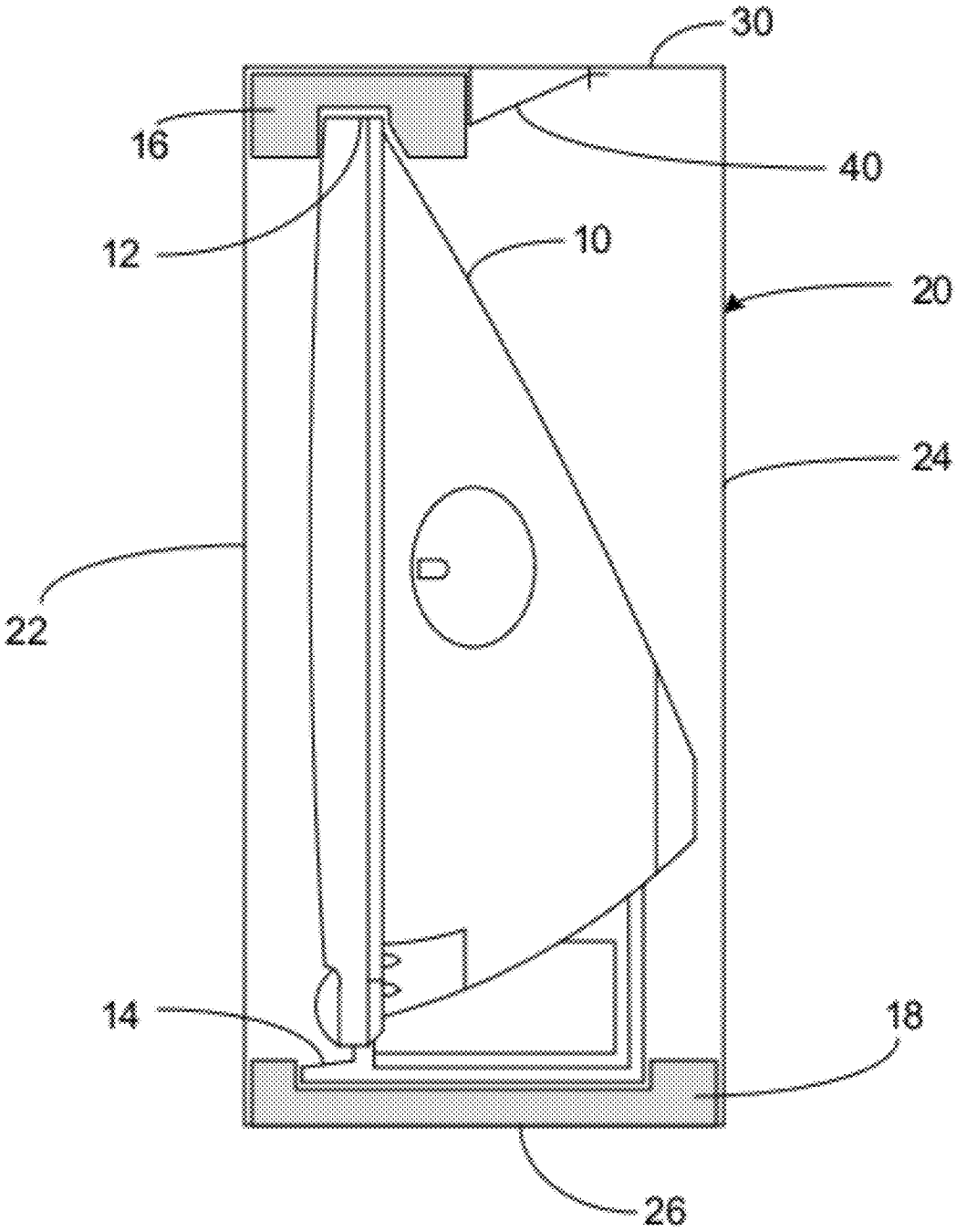
FIG. 1 is a side view of an embodiment of a shipping carton with an integral cushion support and a television positioned therein.

Turning the figures, a shipping carton 20 with an integral cushion support 40 is shown. Like conventional cartons, a preferred embodiment of the carton 20 includes a bottom 26, two side walls 22 and 24 and two end walls 28 and 29 extending vertically from the bottom 26, and a top 30 coupled to the top ends of the side and end walls 22 and 24. As depicted in FIG. 1, a device such as a television 10 is positioned within the interior of the carton 20 with its base 14 positioned on a base support block 18 and at least a portion of its top 12 operably engaged by a support member block 16. the base support block 18 and support member block 16 are formed from a polystyrene foam or other conventional packaging material.

In operation, with the top and bottom 30 and 26 of the carton 20 closed, an cushion support member 40 abuts or engages the support member block 16. The cushion support 40 holds the support member block 16 in place against the side wall 22 of the carton 20, which in turn holds the television 10 in spaced relation with the side and end walls 22, 24, 28 and 29 of the carton 20. The cushion support 40 advantageously reduces the amount of cushion material needed for packaging the television 10 and advantageously reduces the impact forces transmitted to the television 10, thereby providing better protection to the television than any previous design.

Figure 2:
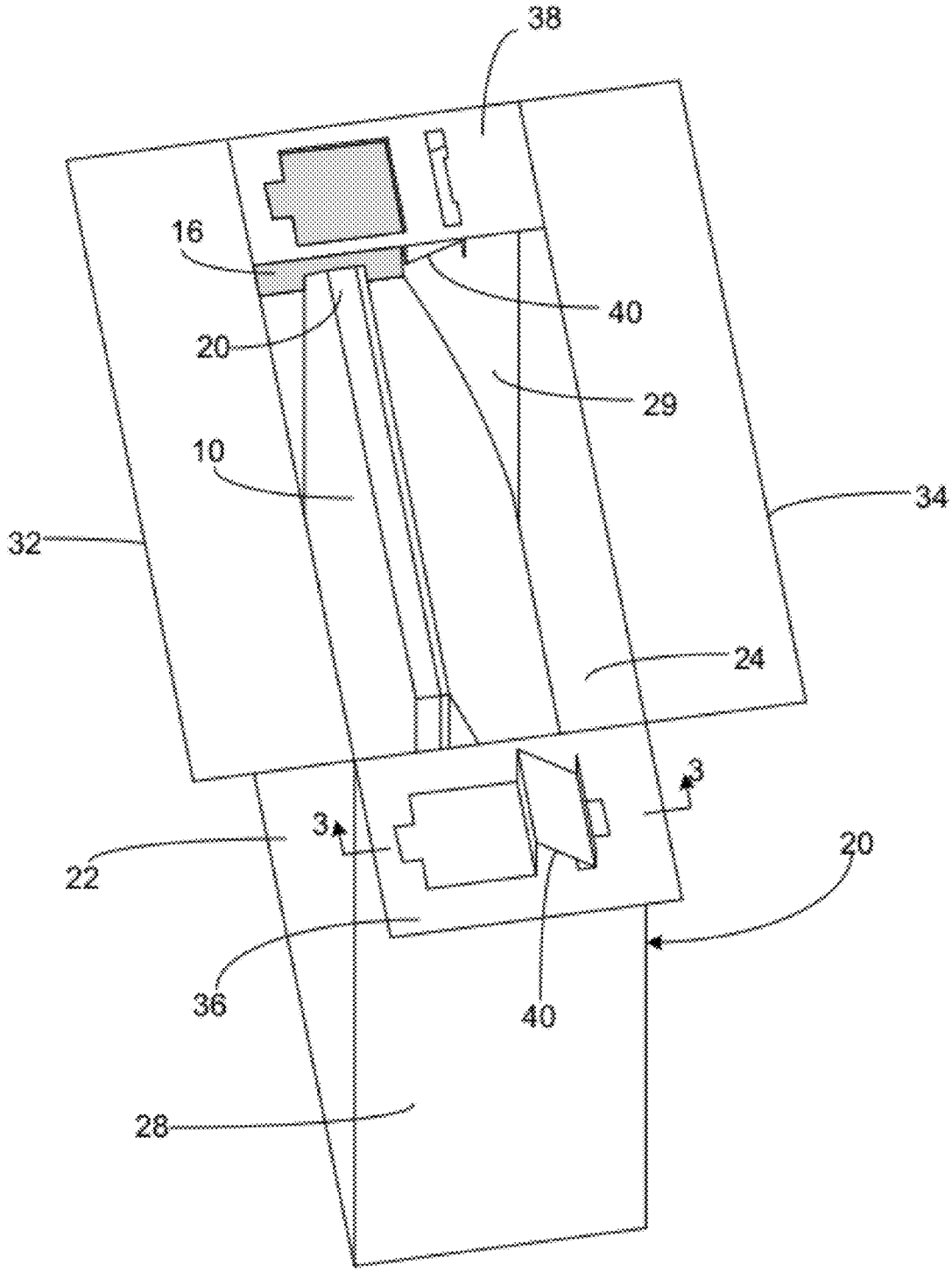
FIG. 2 is a perspective view of the shipping carton with the integral cushion support and a television positioned therein.
Figure 3:
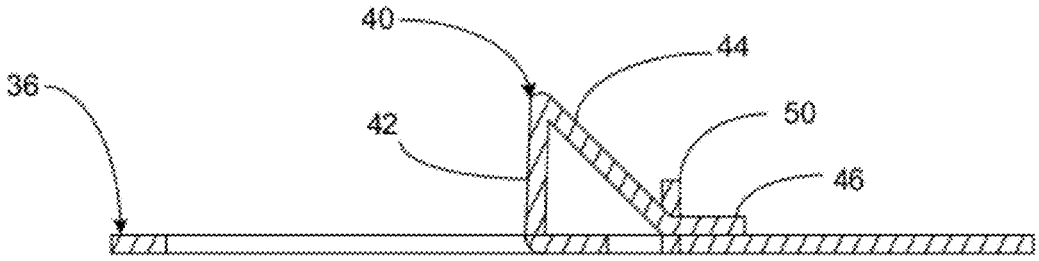
FIG. 3 is a detailed cross-section view of an end flap and integral cushion support taken along line 3-3 in FIG. 2.

Turning to FIGS. 2 and 3, the top 26 of the carton 20 include two side flaps 32 and 34 and two end flaps 36 and 38 that are used to close the top 30 of the carton 20 in a conventional manner. Although not shown, the bottom 26 includes the same flap configuration as the top 30 of the carton 20. The end flaps 36 and 38 preferably include a integrally formed cushion support 40 that includes an elongate body having a triangular cross-sectional shape defined by a vertical wall 42 extending away from the face of the end flap 36, 38 and an inclined wall 44 extending from the end of the vertical wall 42 towards the face of the end flap 36,38. One or more locking tabs 46 extend from the end of the inclined wall 44 and engages one or more slots formed in the end flap 36, 38. Alternatively, a locking tab 50 extends away from the face of the end flap 36, 38 in the same direction as the vertical wall 42 of the cushion support 40 and includes a locking slot 58 (see FIG. 5) formed adjacent the face of the end flap 36, 38 that is engaged by the one or more locking tabs 46 to lock the cushion support 40 in place.

Figure 4:
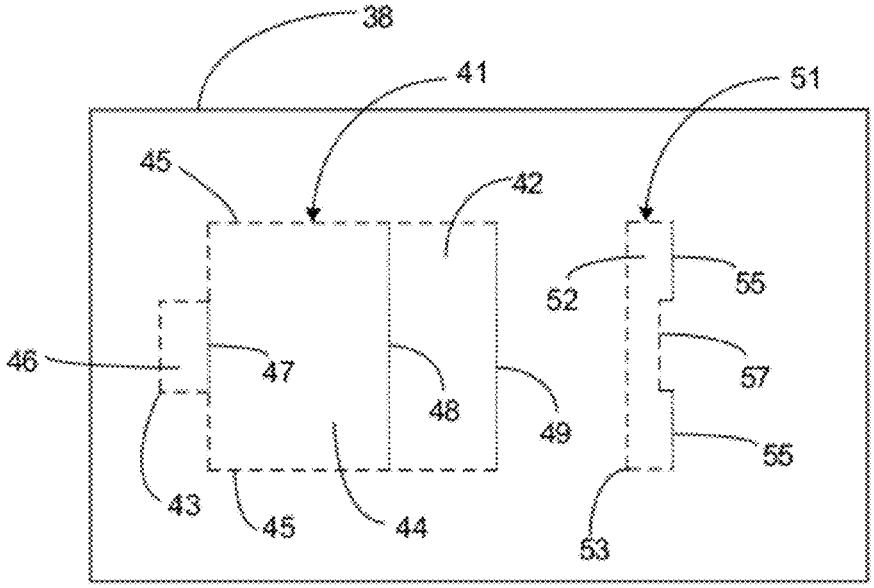
FIG. 4 is a plan view of an end flap of the carton showing the cut and scoring pattern used to form the cushion support.

Referring to FIG. 4, the cushion support 40 and locking tab 50 are formed by cutting and scoring the end flaps 36 and 38 according to the depicted patterns 41 and 50. To form the vertical wall 42 and inclined wall 44 of the body of the cushion support 40 the end flap 36, 38 are through cut along cut lines 45. The locking tab 46 is formed by cutting through the end flap 36, 38 along cut line 43. The end flap 36, 38 is scored along score lines 47, 48 and 49 to allow the cut out portion of the end flap 36, 38 to be folded to allow assembly of the cushion support 40 with the vertical wall 42 extending away from the face of the end flap 36, 38 and the inclined wall 44 extending from the end of the vertical wall 42 towards the face of the end flap 36,38 as shown in FIG. 3.

To form the body 52 of the locking member 50 and the locking slot 58 formed therein, the end flap 36, 38 is cut through along cut lines 53 and 57. Score line 55 is used to bend the body 52 of the locking member 50 away from the end flap 36, 38 in the same direction as the vertical wall 42 of the cushion support 40.

Figure 5:
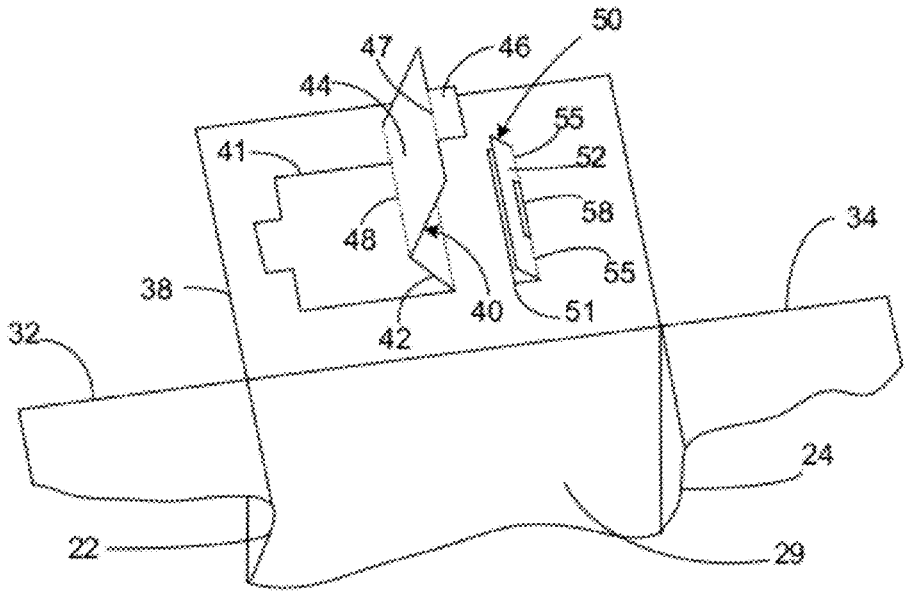
FIG. 5 is a partial perspective view of the shipping carton prior to assembly of the integral cushion support.
Figure 6:
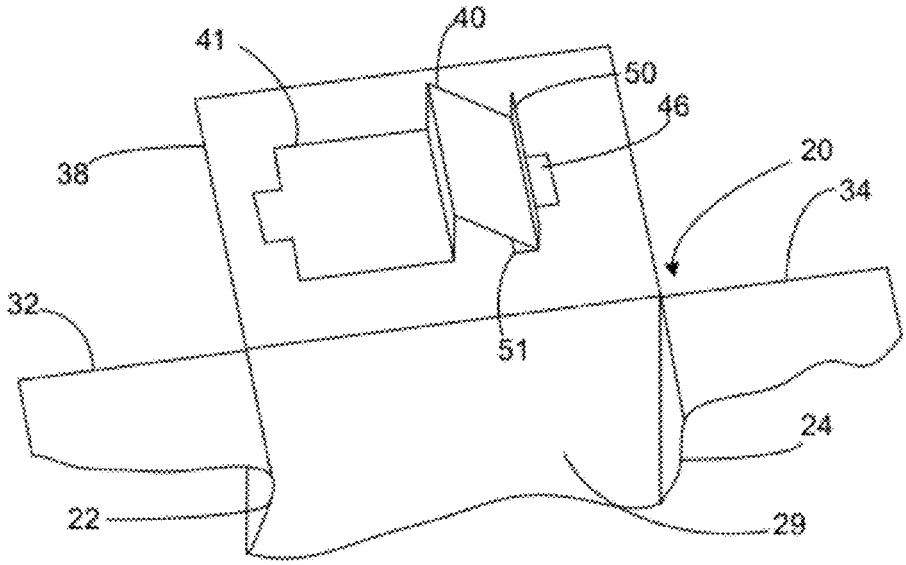
FIG. 6 is a partial perspective view of the shipping carton with the integral cushion support assembled.

To assemble, as shown in FIGS. 5 and 6, the cushion support 40 is bent at score lines 49 and 48 to form the vertical wall 42 extending away from the face of the end flap 34 and direct the inclined wall 44 back toward the face of the end flap 36, 38. The locking member 50 is bent at score line 55 to direct it in the same direction as the vertical wall 42 of the support cushion 42. The locking tab 46 is bent at score line 47 to enable it to engage or extend through the locking slot 58 in the body 52 of the locking member 50.

In operation, the bottom 26 of the carton 20 is closed and the equipment 10 to be shipped, such as a television or other electronic device, is positioned within the carton 20. When the end flaps 36 and 38 of the top 30 of the carton 20 are turned in for closing the top 30 of the carton 20, the vertical wall 42 of the cushion support 40 abuts or otherwise engages the support member block 16 that is operably engaging at least a portion of the top 12 of the television 10. The cushion support 40 holds the support member block 16 in place against the side wall 22 of the carton 20, which in turn holds the television 10 in spaced relation with the side and end walls 22, 24, 28 and 29 of the carton 20. The cushion support 40 advantageously reduces the amount of cushion material needed for packaging the television 10 and advantageously reduces the impact forces transmitted to the television 10, thereby providing better protection to the television than any previous design.

In the foregoing specification, the invention has been described with reference to specific embodiments thereof. It will, however, be evident that various modifications and changes may be made thereto without departing from the broader spirit and scope of the invention. For example, the reader is to understand that the specific ordering and combination of process actions shown in the process flow diagrams described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A shipping carton comprising:

a bottom, first and second side walls and first and second end walls extending vertically from the bottom, and a top coupled to the first and second side and end walls, wherein the top and bottom include first and second side flaps coupled to the first and second side walls and first and second end flaps coupled to the first and second end walls, and wherein one or more of the first and second end flaps of the top include a integrally formed cushion support having an elongate body with a triangular cross-sectional shape;

wherein the body of the cushion support is defined by a vertical wall extending away from the face of the end flap and an inclined wall extending from the end of the vertical wall towards the face of the end flap;

one or more locking tabs extending from the end of the inclined wall and engaging one or more slots formed in the end flap; and a locking member extending away from the face of the end flap in the same direction as the vertical wall of the body of the cushion support, wherein the one or more slots are formed in the locking member adjacent the face of the end flap.

2. A shipping carton comprising:

a bottom, first and second side walls and first and second end walls extending vertically from the bottom, and a top coupled to the first and second side and end walls, wherein the top and bottom include first and second side flaps coupled to the first and second side walls and first and second end flaps coupled to the first and second end walls, and wherein one or more of the first and second end flaps of the top include a cushion support cut out and extending from an interior of the end flap in spaced relation with the periphery of the end flap, wherein the cushion support extends at a first end from the end flap into an interior of the shipping carton when the ends flaps and side flaps assembled to enclose the interior of the shipping carton and lockably engages the end flap at a second end.

3. The shipping carton of claim 2, wherein the cushion support has an elongate body with a triangular cross-sectional shape.

4. The shipping carton of claim 2, wherein the cushion support is positionable along a length of the end flap to abut an article housed in the shipping carton.

5. The shipping carton of claim 2, wherein the cushion support has a body having a vertical extending away from the face of the end flap and an inclined wall extending from an end of the vertical wall towards the face of the end flap.

6. The shipping carton of claim 2, wherein the cushion support includes one or more locking tabs extending from the second end and engaging one or more slots formed in the end flap.

7. The shipping carton of claim 2, further comprising a locking member extending away from the face of the end flap in the same direction as the cushion support and lockably engageable with the second end of the cushion support.

8. A shipping carton comprising:

a bottom, first and second side walls and first and second end walls extending vertically from the bottom, and a top coupled to the first and second side and end walls, wherein the top and bottom include first and second side flaps coupled to the first and second side walls and first and second end flaps coupled to the first and second end walls, and wherein one or more of the first and second end flaps of the top include a cushion support and a locking member cut out and extending from an interior of the end flap in spaced relation with the periphery of the end flap, wherein the cushion support and locking member extend into an interior of the shipping carton from a face of the end flaps and lockably engaging one another.

9. The shipping carton of claim 8, wherein the cushion support has an elongate body with a triangular cross-sectional shape.

10. The shipping carton of claim 8, wherein the cushion support is positionable along a length of the end flap to abut an article housed in the shipping carton.

11. The shipping carton of claim 8, wherein the cushion support has a body having a vertical extending away from the face of the end flap and an inclined wall extending from an end of the vertical wall towards the face of the end flap.

12. The shipping carton of claim 8, wherein the cushion support includes one or more locking tabs extending from the second end and engaging one or more slots formed in the locking member.

* * * * *